United States Patent [19]

Kolb

[11] 4,043,220

[45] Aug. 23, 1977

[54] ADJUSTABLE CONTROLS OF A WORK VEHICLE

[75] Inventor: David L. Kolb, St. Charles, Mo.

[73] Assignee: Caterpillar Tractor Co., Peoria, Ill.

[21] Appl. No.: 697,882

[22] Filed: June 21, 1976

[51] Int. Cl.[2] ..... G05G 1/06; G05G 5/18

[52] U.S. Cl. ..... 74/543; 16/21; 74/491; 74/523; 74/527

[58] Field of Search ..... 74/479, 491, 523, 527, 74/543; 16/121

[56] References Cited

U.S. PATENT DOCUMENTS

| | | | |
|---|---|---|---|
| 1,825,577 | 9/1931 | Carr | 74/479 |
| 3,282,123 | 11/1966 | Klingaman | 74/479 |
| 3,742,204 | 6/1973 | Price | 74/543 X |

*Primary Examiner*—Allan D. Herrmann
*Attorney, Agent, or Firm*—Frank L. Hart

[57] ABSTRACT

In the controls of a work vehicle having first and second shafts each movable between first and second positions along pathways generally parallel one to the other, a knob is eccentrically connected to each shaft with the largest overhanging position of each knob being controllably movable to preselected positions about the center line of the shaft for positioning the knobs to accommodate the size of the operator's hand.

5 Claims, 5 Drawing Figures

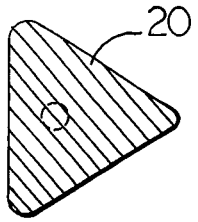
Fig. 3.
Fig. 4.
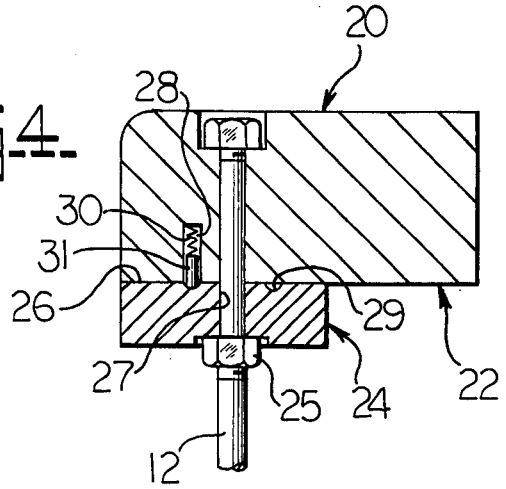
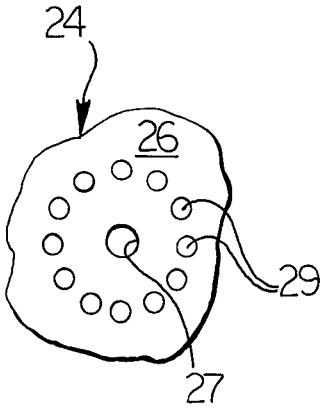
Fig. 5.

ADJUSTABLE CONTROLS OF A WORK VEHICLE

BACKGROUND OF THE INVENTION

Work vehicles often have controls that are activated by first and second shafts that are each movable between first and second positions along pathways that are generally parallel one to the other. These control shafts are also often desirably positioned at different locations along their individual pathways with said positions being relative one to the other for coordinating responsive actions of controlled elements of the vehicle. It therefore becomes necessary for the operator to know the relative positions of the shafts and change one or both of the shafts to other relative locations. This action is also desirably carried out by touch, as opposed to visual orientation of the shafts relative one to the other. It is thus necessary that the shafts be spanned by an operator's hand even when one of the shafts is located at a considerably advanced position along its pathway relative to the other shaft.

This invention, therefore, resides in control shafts having eccentrically connected knobs that are controllably adjustable for readily changing the space between the knobs to a multiplicity of preselected values.

BRIEF DESCRIPTION OF THE DRAWINGS

FIG. 3 is a diagrammatic plan view in sections of one of the knobs of FIG. 2;

FIG. 4 is a diagrammatic frontal view in partial section of another embodiment of the knob assembly; and FIG. 5 is a diagrammatic plan view of a portion of the base of FIG. 4.

DETAILED DESCRIPTION OF THE INVENTION

Figure 1:
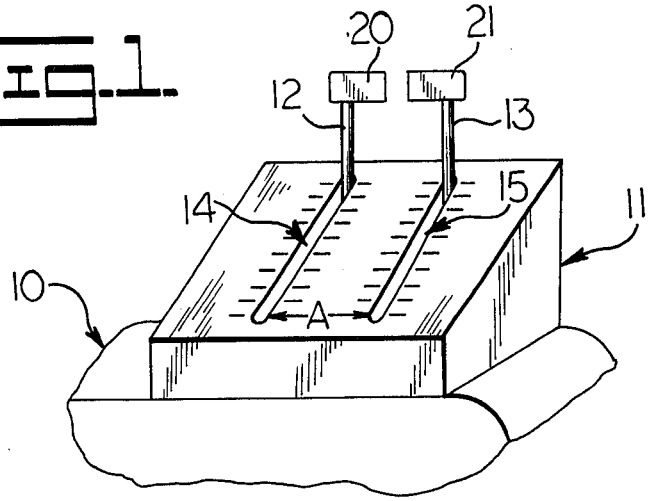
FIG. 1 is a diagrammatic perspective view of a vehicle having the controls of this invention.

Referring to FIG. 1, a work vehicle 10, for example a track-type loader, has a control assembly 11 for manipulating separate elements of the vehicle 10. The control assembly 11 has first and second shafts 12,13 each movable independently between a first position shown and a second position indicated by letter "A". The shafts 12,13 move between the first and second positions along respective pathways 14,15 that are generally parallel one to the other. Such controls, the operation thereof, and the positioning of one shaft relative to the other during operation of the vehicle 10 are well known in the art and further description is eliminated for purposes of brevity.

Figure 2:
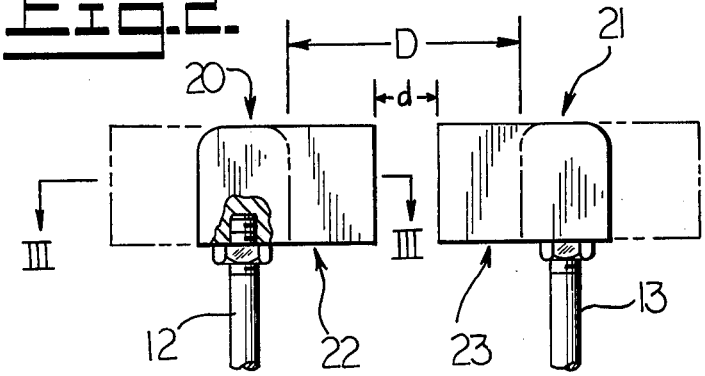
FIG. 2 is a diagrammatic frontal view of a portion of the controls.

Referring to FIG. 2, each of the shafts 12,13 has a respective knob 20,21 connected thereto. The knob can be connected by threads on the end position of the shafts 12,13 mating with threads of the knobs 20,21 or by other means, such as the shafts and nuts of FIG. 4. However, it is necessary that each knob 20,21 be eccentrically connected to the respective shaft 12,13 with the largest overhanging portion 22,23 of each respective knob 20,21 being controllably movable to preselected positions about the center line of the respective shaft. The connection between the knobs 20,21 and the shafts 12,13 should therefore be of a construction which permits rotation of the knobs 20,21 through at least 180° while maintaining the forces required for said rotation at a preselected elevated value. That force value should be greater than the force required to move the respective shaft between the first and second positions so that the knobs will not rotate in response to forces imparted thereonto for moving the respective shaft along its pathway.

The knobs 20,21 are of a configuration sufficient for rotational movement of the knobs 20,21 to positions on their respective shafts 12,13 at which the space between adjacently positioned knobs is in the range of about 1 inch to about 6 inches as shown by letters *d* and *D*. At less than about 1 inch spacing, the gloved hand of an operator cannot desirably "feel" the relative positioning of the shafts and also might pinch his hand between the knobs 20,21. At greater than about 6 inch spacing, the hand of the average operator is not sufficiently large to effectively span the space between the knobs 20,21 especially where said shafts 12,13 are desired to be positioned at different, widely spaced locations along their respective pathways 14,15.

Referring to FIG. 3, the cross sectional configuration of each knob 20,21 taken perpendicularly to the axis of the respective shaft 12,13 in the installed position of the knobs 20,21 is preferably other than circular in order that the operator can sense by touch the relative positions of the knobs 20,21 on their respective shafts 12,13.

Referring to FIG. 4 which shows an example construction of the knobs 20,21, a base 24 is fixedly connected to the shaft 12 by a countersunk nut 25, for example. The base 24 has a plurality of depressions 29 formed on a first or upper surface 26 of the base 24 about an opening 27 for the shaft as better seen in FIG. 5. A chamber 28 is formed in the knob 20 adjacent the depression 29 in the installed condition of the knob 20 on the shaft 12 over the base 24. A spring means 30 is positioned in the chamber 28 with a keeper element 31 positioned between the spring means and the base 24. The spring means 30 biases the keeper element 31 into forcible contact with the base 24. During rotation of the knob 20, the keeper element 31 is slidably movable into an adjacent depression 29 for more firmly maintaining the knob 20 against rotation in response to a preselected amount of rotational force. Rotation of the knobs can also be provided by other means such as by the construction of interfering mating threads, for example, among others.

In the operation of the apparatus, the operator can rotate the knobs 20, 21 to comfortably accommodate his hand and by "touch" determine which direction to rotate one or both knobs to change their positions for expected forthcoming changes in the relative positions of the shafts along their pathways.

By so utilizing the apparatus of this invention, the operator is able to more exactly and efficiently maintain control over elements of the vehicle.

Other aspects, objects and advantages of this invention can be obtained from a study of the drawings, the disclosure, and the appended claims.

What is claimed is:

1. In the controls of a work vehicle having first and second shafts, each movable between first and second positions along pathways generally parallel one to the other, the improvement comprising:

a knob connected to each shaft, each of said knobs being eccentrically connected to the shaft with the largest overhanging portion of each knob being controllably movable to preselected positions about the center line of its respective shaft.

2. Apparatus, as set forth in claim 1, wherein the cross sectional configuration of each knob taken perpendicularly to the axis of the shaft in the installed position is other than circular.

3. Apparatus, as set forth in claim 1, wherein the knobs are of a configuration sufficient for rotational movement of the knobs to positions on their respective shafts at which the space between adjacent knobs is in the range of about 1 inch to about 6 inches.

4. Apparatus, as set forth in claim 1, including: means for releasably maintaining each knob at a preselected position on its respective shaft.

5. Apparatus, as set forth in claim 4, wherein each means comprises:

a base fixedly connected about the shaft, said base having a plurality of depressions about a first surface thereof;

a chamber formed in the knob;

spring means positioned in the chamber; and a keeper element positioned in the chamber and being biased into contact with the base by the spring.

* * * * *